United States Patent [19]

Phillips

[11] Patent Number: 4,644,722

[45] Date of Patent: Feb. 24, 1987

[54] REPAIRING UTILITY POLES

[75] Inventor: Cecil L. Phillips, Boughton, Great Britain

[73] Assignee: Scott Bader Company Limited, Great Britain

[21] Appl. No.: 787,092

[22] Filed: Oct. 15, 1985

[30] Foreign Application Priority Data

Oct. 16, 1984 [GB] United Kingdom ..... 8426085

[51] Int. Cl.[4] ..... E02D 5/60; E04G 21/00

[52] U.S. Cl. ..... 52/514; 52/170; 52/726; 52/746

[58] Field of Search ..... 52/170, 514, 726, 722, 52/725, 728, 744, 746, 297, 516; 405/84, 211, 216

[56] References Cited

U.S. PATENT DOCUMENTS

| | | | |
|---|---|---|---|
| 1,113,558 | 10/1914 | Illingworth | 52/170 X |
| 1,461,046 | 7/1923 | Patterson | 52/514 X |
| 1,596,657 | 8/1926 | Heber | 52/170 X |
| 2,724,156 | 11/1955 | Shaw | 52/170 X |
| 2,897,553 | 8/1959 | Gorrow | 52/721 |
| 3,362,124 | 1/1968 | Cravens et al. | 52/514 |
| 3,390,951 | 7/1968 | Finger et al. | 52/516 |
| 3,934,422 | 1/1976 | Fredrickson et al. | 52/514 X |
| 4,244,156 | 1/1981 | Watts | 52/170 X |
| 4,306,821 | 12/1981 | Moore | 405/216 |
| 4,543,764 | 10/1985 | Kozikowski | 52/514 X |

FOREIGN PATENT DOCUMENTS

| | | | |
|---|---|---|---|
| 601727 | 12/1925 | France | 52/170 |
| 125068 | 7/1920 | United Kingdom . | |
| 429665 | 6/1935 | United Kingdom . | |
| 1199725 | 7/1970 | United Kingdom . | |
| 1489518 | 10/1977 | United Kingdom . | |
| 1550403 | 8/1979 | United Kingdom . | |

*Primary Examiner*—J. Karl Bell

*Attorney, Agent, or Firm*—Cushman, Darby & Cushman

[57] ABSTRACT

A method and kit for repairing in situ a utility pole, especially a wooden one, when damaged at around ground level uses a sleeve to surround a substantial length of a pole and a non-shrink hardenable pourable composition to occupy a clearance between the sleeve and the pole and form a solid core bonded to both of them, so as to yield a very strong assembly. Preferably the sleeve is of two identical parts clipped together round the pole, and the composition is a magnesium phosphate cement.

14 Claims, 4 Drawing Figures

REPAIRING UTILITY POLES

FIELD OF THE INVENTION

The invention relates to the in-situ repairing of utility poles.

BACKGROUND OF THE INVENTION

Utility poles are widely used to support overhead power and telecommunication lines. Wooden utility poles are pressure impregnated before installation with materials such as creosote to minimise rotting but this still occurs, usually from the centre outwards.

The reasons for rotting usually are that (a) the preservative does not penetrate to the centre of the poles; and (b) some soils contain chemical compounds that are particularly aggressive even towards treated timbers.

Any rotting puts the poles at risk due to failure at or just above ground level where the maximum bending moment is applied. High bending stresses occur during extreme weather conditions and even new poles can be broken. For this reason poles which have lost more than 40% of their integrity (i.e. have a strength less than 40% of their original nominal strength) are replaced. This is not always easily accomplished as poles are often located in sites inaccessible to transport so that lengthy disruption of services can occur. Even though they may rot, wooden poles are still preferred in many parts of the world because of the availability of the wood (and they are comparatively easily climbed by a properly equipped workman). Alternatives to wooden poles such as reinforced concrete and glass reinforced plastics can also suffer damage at or about ground level.

The present invention is designed to provide a means and method for the in situ repair of utility poles.

Such a repair system to be viable should be capable of reinforcing poles to an acceptable strength equivalent to that of new ones, should be easy to accomplish on site, should need access only to the base of the pole so that there is no disruption of services, and should be resistant to corrosive and other attack so as to give a pole a long life without further main- tenance.

Various systems for repairing elongate members have been proposed in the art.

For example, GB-A-1489518 shows a way of repairing piles underwater by cutting away a rotten part of the pile, surrounding it with a bag and pouring cement into the bag. The rotten part is effectively replaced by the concrete. The concrete, which may have a larger dimension than the original pile, is the only added load-bearing element. A small excavation may be made into the earth at the bottom of the pile and concrete may enter it, but it is not surrounded by the bag at that position. The purpose is to resist vertical loads.

GB-A-1550403 shows a way of strengthening structural tubes of an oil-rig by surrounding a damaged part by a sleeve, filling it under pressure with a hardenable composition and maintaining the pressure until the composition has hardened.

There have also been proposals for setting poles in their new condition into the earth and protecting them against rot; by filling a cavity in the earth with foam and setting the pole in it (GB-A-1199725); by forming a concrete pot in a cavity and then packing a pole into the pot with rubble or the like which is filled with a preservative (GB-A-429665); by setting them in a sleeve in the ground of which the upper end just projects from the surface (GB-A-433428); or by forming a solid protective layer on the pole before it is inserted into the ground (GB-A-125068).

SUMMARY OF THE INVENTION

None of this prior art shows the present invention, which is primarily concerned with the repair of utility poles at a region above and below ground-level.

According to the invention means for repairing in situ a utility pole projecting out of the ground comprise a rigid sleeve for positioning around the pole over a substantial length thereof in the region of the damaged portion of the pole usually at the transition from below-ground to above-ground ground, the inner periphery of the sleeve being spaced from the pole and a hardenable core material for placing in the space between the pole and the sleeve. The means may further include a stop for the bottom of the sleeve to prevent egress of the core material from that bottom.

The invention further provides a utility pole surrounded for a substantial length in its damaged portion by a composite comprising a hardened core surrounding and bonded to the material of the pole and hardened in situ between the pole and a sleeve surrounding the core.

Furthermore the invention provides a method of repairing utility poles comprising placing a sleeve around the pole and spaced from it over a substantial length of the pole at its damaged portion and filling between the sleeve and the pole with a hardenable core material and allowing the hardenable core material to harden. The material may be selected to bond both to the sleeve and the pole. There must be at least a mechanical bond between all three elements (pole core and sleeve) to achieve the desirable results of the invention.

It can be seen that these expedients give a readily-usable in-situ repair capacity. The repaired pole has three structural components in the repaired region; itself, the hardened core and the sleeve: the latter remaining as part of the finished assembly.

In all these aspects the sleeve may be a split sleeve being split lengthwise into two or more portions and being joinable together mechanically, adhesively or by both methods. Preferably it will be positioned so that it is approximately equally below and above ground (which will normally require excavation of the ground immediately around the pole).

A preferred clearance between the pole and the sleeve is between 10 and 75 mm all round. A preferred length for the sleeve is usually between 0.5 m and 3 m, which will usually be evenly shared between above and below ground portions of the pole. As a rule of thumb, the length of the sleeve should be the length of the damaged or rotted area plus 0.5 m.

During bending the principal stress is in the tensile plane, so the sleeve or its material may have highly directional (anisotropic) properties, i.e. high strength in the direction of the sleeve length. Such sleeves can be made from unsaturated polyester, vinyl ester or epoxide resins reinforced with glass, polyaramide, carbon or metallic fibres preferably running at least primarily in the direction of length of the sleeve. Pultrusion is one method of manufacture but other moulding processes can be used. Glass reinforced cement (GRC) and reinforced thermoplastics can also be used as the sleeve.

Isotropic materials which have equivalent strengths in the principal direction to the above anisotropic materials such as stainless and alloys, other corrosion resistant metals and coated metals can also be employed to take the sleeve.

To ensure good adhesion between core material and the sleeve the inner surface of the sleeve may be roughened and/or treated with a primer.

Likewise the surface of the pole should be treated before putting the sleeve in place to remove any loose material, dirt etc and primed if necessary.

At the bottom of the sleeve there should be a unit which seals the orifice between the sleeve and the pole and this may at the same time locate the pole centrally to the sleeve. Alternatively with some core materials the seal may be made with earth.

The core material can be a wide range of substances both inorganic and organic which fulfil two functions:

(a) bonding to both sleeve and pole, at least in the mechanical sense of cohering or adhering with them, and preferably forming a full physico-chemical bond.

(b) allow the load transfer from pole to sleeve when bending stresses are applied.

These core materials should be readily handleable on site, be usable under varying weather conditions, have minimum, preferably zero, volume shrinkage, be of sufficiently low viscosity to fill cracks and fissures in the wooden pole, be pourable in stages without problems and be stable and weather resistant. Cure of the core to a crosslinked state should be rapid.

Among the suitable core materials are:

Grouting cement formulated to give zero volume shrinkage.

Fast setting magnesium phosphate cements e.g. as described by Abdenlrazig et al, British Ceramic Proceedings No. 35 Sept. 84 pages 141–154.

High density urethane foam systems.

Cast thermoset resins with antishrink additives.

A particular embodiment of the invention and method of carrying it out will now be described with reference to the accompanying drawings wherein.

Figure 1:
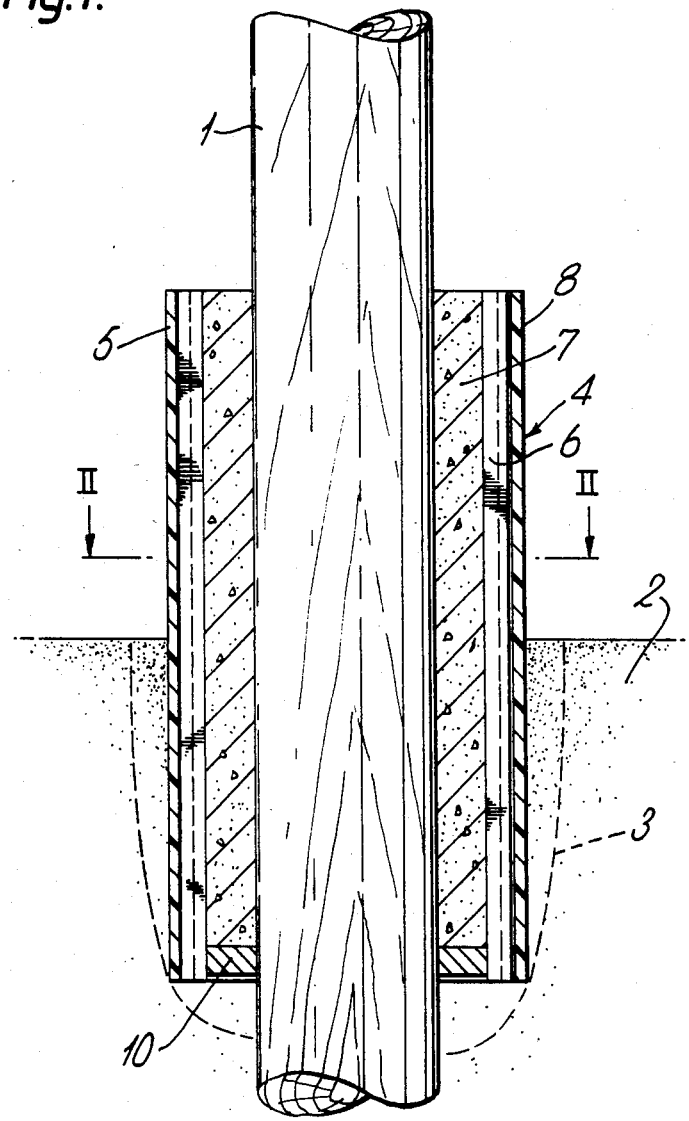
FIG. 1 is a diagrammatic section through a utility pole about where it leaves the ground.
Figure 2:
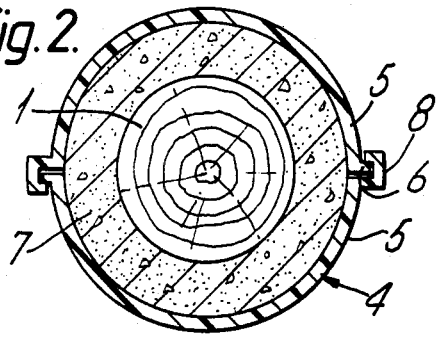
FIG. 2 is a section on the line plane 2.2 of FIG. 1.
Figure 3:
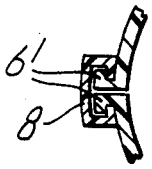
FIG. 3 shows an alternative on the same section.

With reference to the drawings, a utility pole 1 may be a cylindrical wooden pole and has previously been set in the ground 2 by the digging or boring of a hole. If damage or attack has occurred to the pole at or below ground level (which is the most common position for such damage, corrosion or rotting) it is repaired by the excavation around the pole of a small void (dotted lines 3) and the placing around it of a multipart sleeved construction 4. As seen in FIG. 2 in the present embodiment, this construction has two equal and identical halves 5 which can be clipped together by manual distortion of the sleeves, so that flange 6 is trapped by claw 8, each extending along respective edges of the half-sleeves. An alternative method of clipping the halves together is shown in FIG. 3, with a U-strip 9 passed over the out-turned flanges 6'. At the bottom and indeed elsewhere on the sleeve may be spacers for maintaining a regular and desired spacing between the inner circumference of the sleeve parts and the pole. The appropriate spacing will depend on the dimensions of the pole and its expected loading. As seen in FIG. 1, a ring 10 closed around the pole may act simultaneously as spacer and as a seal for the bottom of the sleeve.

A preferred length for the sleeve also depends on loading considerations but a standard length of 2meters, of which 1 meter is intended to be below and 1 meter above ground will serve for most purposes.

Once placed the gap between the sleeve and the pole is filled with a hardenable core material 7 the general nature of which has already been discussed and which is to bond both to the pole and to the sleeve. The material is then left to harden in situ. The gap may be filled through an aperture in the flange 6 or in the wall of the sleeve parts 5, or from the top of the gap.

A roof element to prevent trapping of moisture on top of the sleeve may also be provided either integrally with the sleeve, or separately.

Example I

As a model a 19 mm wooden rod was tested to destruction to determine the strength. An equivalent rod was then bored out for 60 mm so that the strength was reduced to 60% of the original.

A glass reinforced polyester pultruded sleeve of 33 mm internal diameter and 2.5 mm wall thickness was placed around the bored-out end of the rod to cover 120 mm (equivalent to 2 m in a full scale situation). The gap between the rod and the sleeve was filled with non-shrink magnesium phosphate cement (6% water in paste) and allowed to cure for 3 days at room temperature.

The specimen was then supported in a specially designed jig to simulate loading at one end (e.g. wind loading on a power line) with the repaired end clamped at the equivalent of ground level i.e. 60 mm from the end. The free end was loaded until failure occurred. The failure occurred in the wooden rod beyond the repair i.e. outside the damaged zone indicating that the repair had restored the original properties of the rod. The load to failure was equivalent to that in the original undamaged rod.

Example II

Repairs were made on two full size poles A and B in which damage had been simulated by cutting V notches at the position of maximum bending moment to simulate ground level damage. The V-notches were filled with foam of no significant mechanical strength to prevent ingress of cement into the V's . Glass reinforced plastic (GRP) sleeves were then fitted round each pole, each sleeve being 2 meters long and consisting of half-round sections 5 and fixed with GRP clips 8 which slid on flanges 6' as shown in FIG. 3. The spacing from the pole was about 22 mm all round. The core material 7 was a non-shrink magnesium phosphate cement as described by Abdelrazig et al, loc cit.

Figure 4:
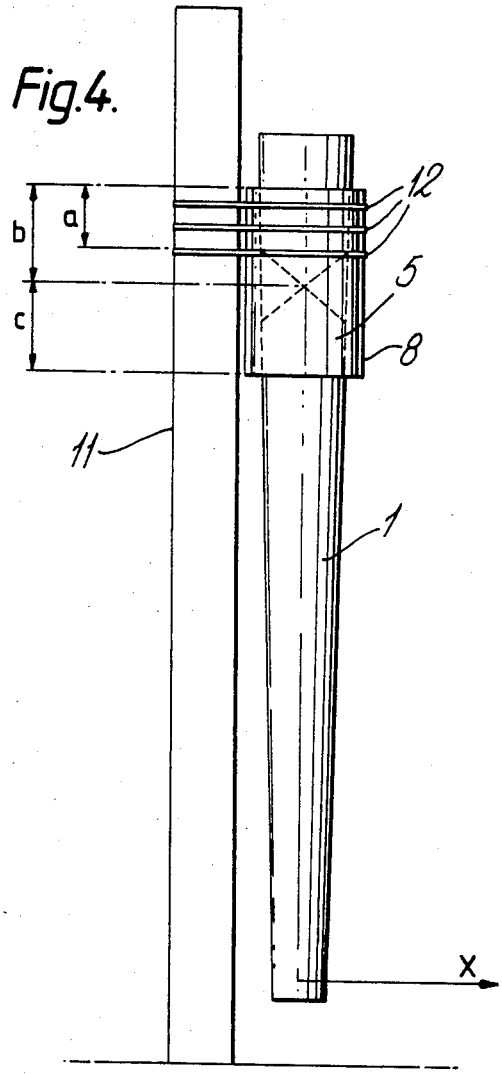
FIG. 4 shows a test rig.

Fourteen days after the repair was made the poles 1 were tested in a special rig in which they were held vertically on a support frame 11 by support straps 12 near the repaired end as shown in FIG. 4. Dimension a is 0.5 m, b and c, 1 m. Loads were applied horizontally along arrow x at the undamaged end and the results obtained are shown in Table I. As can be seen the percentage of nominal strength attained was very high. In both cases the figure of 60%, which has been regarded as acceptable, was well exceeded, and similar successful results would be obtained using a minimal-shrink grouting cement or a minimal-shrink non-reinforced thermoset resin.

TABLE

BREAK TEST RESULTS

| | POLE A | POLE B |
|---|---|---|
| Overall length of pole | 9952 mm | 9917 mm |
| Mid-position of sleeve from butt | 1500 mm | 1500 mm |
| Circumference (Mean) of the pole at 1.5 m from butt | 755 mm | 753 mm |
| Loading position distance from tip | 80 mm | 84 mm |
| Applied Load kg | 780 kg | 880 kg |
| Applied Load kN | 7.65 kN | 8.63 kN |
| Bending Moment applied at 1.5 m from butt | 64.04 kNm | 71.91 kNm |
| Nominal (Theoretical Strength of normal new pole at 1.5 m from butt) | 73.31 kNm | 72.73 kNm |
| Percentage of Nominal Strength attained | 87.35% | 98.87% |
| Mode of failure | Complex | Complex |

I claim:

1. A method of repairing in situ a utility pole projecting from the ground comprising the steps of:

fitting a sleeve of predetermined length around the pole at a predetermined clearance therefrom;

filling the clearance only with a flowable hardenable composition of magnesium phosphate concrete which is to be nonshrinking on hardening; and allowing the composition to harden to a core bonded at least mechanically to the sleeve and to the pole to be the sole means for transmitting shear between them;

whereby to yield an assembly comprising the pole the core and the sleeve in which shear load is substantially sustained by the pole and the sleeve.

2. A method according to claim 1 which further includes the step of excavating the ground around the pole to a predetermined depth and fitting the sleeve to project approximately equally into the excavation and above the level of the ground.

3. A method according to claim 2 wherein the excavation is to a depth of at least 0.25 m the sleeve is at least 0.5 m long and the clearance is between 10 and 75 mm.

4. A method according to claim 3 wherein the length of the sleeve is about 2 m.

5. A method according to claim 1 wherein the sleeve is anisotropic, with high tensile resistance in the direction of its length.

6. A method according to claim 1 wherein the sleeve comprises a plurality of identical parts, the parts being fitted together around the pole.

7. A method according to claim 5, wherein the sleeve is anisotropic, with high tensile resistance in the direction of its length.

8. In combination:

a utility pole projecting upwardly from ground level, a solid core of magnesium phosphate concrete surrounding a damaged region of the pole and solely filling the space therebetween at least mechanically bonded thereto over its contact surface therewith; and a sleeve uninterruptedly surrounding the core and at least mechanically bonded thereto over its contact surface therewith so that shear is transmitted solely by said core from said pole to said sleeve.

9. The combination of claim 8 wherein each of the core and the sleeve are approximately equally below and above the ground level.

10. The combination of claim 8 wherein the sleeve has a length along the pole of about 2 m.

11. The combination of claim 10 wherein the sleeve is of a GRP material with its reinforcement primarily running along its length.

12. A kit for the repair of situ of a damaged wooden pole projecting upwardly from the ground comprising:

a GRP sleeve for positioning around a damaged region of a pole in the vicinity of ground level to project into and from the ground and be spaced from the outer surface of the pole; and a hardenable pourable magnesium phosphate cement which is non-shrinking on hardening and which solely fills the space between said pole and sleeve and mechanically bonds to both the sleeve and the pole to solely transmit shear between said sleeve and wood.

13. A method according to claim 12, wherein the sleeve is anisotropic, with high tensile resistance in the direction of its length.

14. A method according to claim 13, wherein the sleeve comprises a plurality of identical parts, the parts being fitted together around the pole.

* * * * *